US007056166B2

(12) United States Patent
Bernloehr

(10) Patent No.: US 7,056,166 B2
(45) Date of Patent: Jun. 6, 2006

(54) TROLLING MOTOR ASSEMBLY

(75) Inventor: Darrel A. Bernloehr, Mankato, MN (US)

(73) Assignee: Johnson Outdoors Inc., Racine, WI (US)

( * ) Notice: Subject to any disclaimer, the term of this patent is extended or adjusted under 35 U.S.C. 154(b) by 57 days.

(21) Appl. No.: 10/864,299

(22) Filed: Jun. 9, 2004

(65) Prior Publication Data

US 2005/0020150 A1 Jan. 27, 2005

Related U.S. Application Data

(60) Provisional application No. 60/476,946, filed on Jun. 9, 2003.

(51) Int. Cl.
*B60L 11/02* (2006.01)

(52) U.S. Cl. ..... 440/6; 114/144 R

(58) Field of Classification Search ..... 440/6, 440/7, 53, 63, 64; 114/144 R
See application file for complete search history.

(56) References Cited

U.S. PATENT DOCUMENTS 1,161,935 A * 11/1915 Heck et al. ..... 440/63
1,683,893 A * 9/1928 Irgens ..... 440/56
5,465,633 A 11/1995 Bernloehr
5,540,606 A * 7/1996 Strayhorn ..... 440/63
6,213,821 B1 4/2001 Bernloehr et al.
6,232,685 B1 5/2001 Swetish et al.
6,254,441 B1 7/2001 Knight et al.
6,325,685 B1 12/2001 Knight et al.
6,369,542 B1 4/2002 Knight et al.
6,394,859 B1 5/2002 Knight et al.
6,431,923 B1 8/2002 Knight et al.
6,669,516 B1 * 12/2003 Husted et al. ..... 440/6
2003/0024456 A1 * 2/2003 Swetish ..... 114/144 R

* cited by examiner

*Primary Examiner*—Lars A. Olson
(74) *Attorney, Agent, or Firm*—Kinney & Lange, P.A.

(57) ABSTRACT

A trolling motor assembly for use with a watercraft is disclosed. The trolling motor assembly comprises a propulsion unit, a steering control unit, a motor tube, and a mount system having a first portion adapted to be mounted to a watercraft and a second portion adapted to support the propulsion unit. The assembly further comprises an orientation system is configured to re-index the trolling motor assembly between a forward troll position and a back troll position.

62 Claims, 11 Drawing Sheets

TROLLING MOTOR ASSEMBLY

CROSS-REFERENCE TO RELATED PATENT APPLICATIONS

The present Application claims the benefit of priority, as available under 35 U.S.C. § 119(e)(1), to U.S. Provisional Patent Application No. 60/476,946 titled "Trolling Motor Assembly" filed Jun. 9, 2003 (which is incorporated by reference in its entirety).

FIELD OF THE INVENTION

The present invention relates to transom and bow-mounted outboard trolling motors for boats. In particular, the present invention relates to a trolling motor assembly that provides for reorientation or reconfiguration of a propulsion unit between a forward troll position and a back troll position.

BACKGROUND OF THE INVENTION

Outboard trolling motors have become extremely popular for low speed maneuvering of small boats. Their ability to slowly traverse the boat across an area without excessive noise or disturbance of the water has made such trolling motors especially popular with fishermen where fishing by trolling requires slow movement of the boat, where the boat must be moved slowly through congested waters filled with stumps, blowdowns, and dense weed lines, and where it is critical that the fish not be frightened.

Trolling motors are typically mounted either on the bow or transom of a boat and include a submerged propulsion unit, a motor shaft or tube suspending a propulsion unit below the water surface, a generally horizontally extending head at the upper end of the motor shaft and a mounting mechanism rotatably supporting the motor tube and including a clamp for engaging the boat. The submerged propulsion unit typically comprises an electrically powered motor which drives the propeller to generate thrust. To vary the direction of thrust, the head typically includes controls for the submerged propulsion unit and a steering mechanism which rotates the motor tube and the submerged propulsion unit. The steering mechanism typically comprises either a steering arm or foot-operated remote control or a hand-held remote control. Foot-operated and hand-held remote controls typically utilize cables, rods, or other linkages which are operably coupled to a drum or a rack and pinion connected to the motor tube to rotate the motor tube and reorient the submerged propulsion unit with respect to the fixed head. Steering mechanisms utilizing steering arms or tillers require the operator to rotate the arm so as to rotate the motor tube. To avoid the problem of interference between the steering arm and the main outboard motor, other steering mechanisms utilizing tillers utilize a geared mechanism wherein the steering arm moves through a shorter arc or rotation while the propulsion unit longer arc or rotation.

Although widely used, such trolling motors have several associated drawbacks. Trolling motors are generally configured to propel the boat in a forward trolling direction. However, in many situations it is desirable to backtroll wherein the propulsion unit is oriented to propel the boat in a rearward or backward direction. Unfortunately, to orient the propulsion unit for backtrolling normally requires that the tiller or steering arm be extended away from the boat over the water. As a result, it is extremely inconvenient and difficult to steer the boat during backtrolling.

To facilitate back trolling, some trolling motors include a bolt which holds the head to the tube. To reorient the propulsion unit for backtrolling requires that the bolt be removed, that the tube and the propulsion unit be rotated 180 degrees, and that the bolt be replaced. Because this procedure requires disassembly and reassembly of the trolling motor, this procedure is time consuming and inconvenient. Moreover, during this procedure, the bolt is often dropped, misplaced or lost. Other trolling motors such as those disclosed in U.S. Pat. No. 6,213,821 (which is incorporated by reference in its entirety) may provide a gear which is selectively engaged and disengaged to allow for reorientation to a back trolling orientation. However, such a configuration requires that mating gear components be disengaged and re-engaged for proper functioning.

Thus, there is a continuing need for a trolling motor which is easily reindexed or adjusted to alternate between forward trolling and backtrolling without the associated drawbacks of the conventional systems described above.

SUMMARY OF THE INVENTION

One embodiment of the invention relates to a trolling motor assembly for use with a watercraft. The trolling motor assembly comprises a propulsion unit, a steering control unit configured to control the orientation of the propulsion unit, and a motor tube coupling the steering control unit to the propulsion unit. The motor tube includes a first tube section and a second tube section. The trolling motor assembly further comprises a mount system having a first portion adapted to be mounted to a watercraft and a second portion adapted to receive the motor tube, and an orientation system adapted to convert the trolling motor assembly between a first orientation and a second orientation. The orientation system includes an engagement device movable between a first engaged position, a disengaged position, and a second engaged position. The first engaged position corresponds to the first orientation, and the second engaged position corresponds to the second orientation.

Another embodiment of the invention relates to a trolling motor assembly for use with a watercraft. The trolling motor assembly comprises a propulsion unit, a steering control unit, a motor tube having a first tube section and a second tube section, and a mount system having a first portion adapted to be mounted to a watercraft and a second portion adapted to support the propulsion unit. The trolling motor assembly further comprises an orientation system configured to re-index the trolling motor assembly between a forward troll position and a back troll position. The orientation system includes a collar and a pin. The collar is rotated relative the pin to re-index the trolling propulsion unit between the forward troll position and the back troll position.

A further embodiment of the invention relates to a method of converting a trolling motor between a forward trolling position and a back trolling position. The method comprises the steps of coupling an orientation collar having a slot to an outer motor tube section, disengaging an outer locking member from a first aperture in the orientation collar, and rotating a steering control unit in a manner that causes the orientation collar to slidably follow an inner locking member until the outer locking member engages the second aperture. The collar is rotated relative the inner locking member to convert the trolling motor between the forward troll position and the back troll position.

DETAILED DESCRIPTION OF THE PREFERRED EMBODIMENTS

Figure 1:
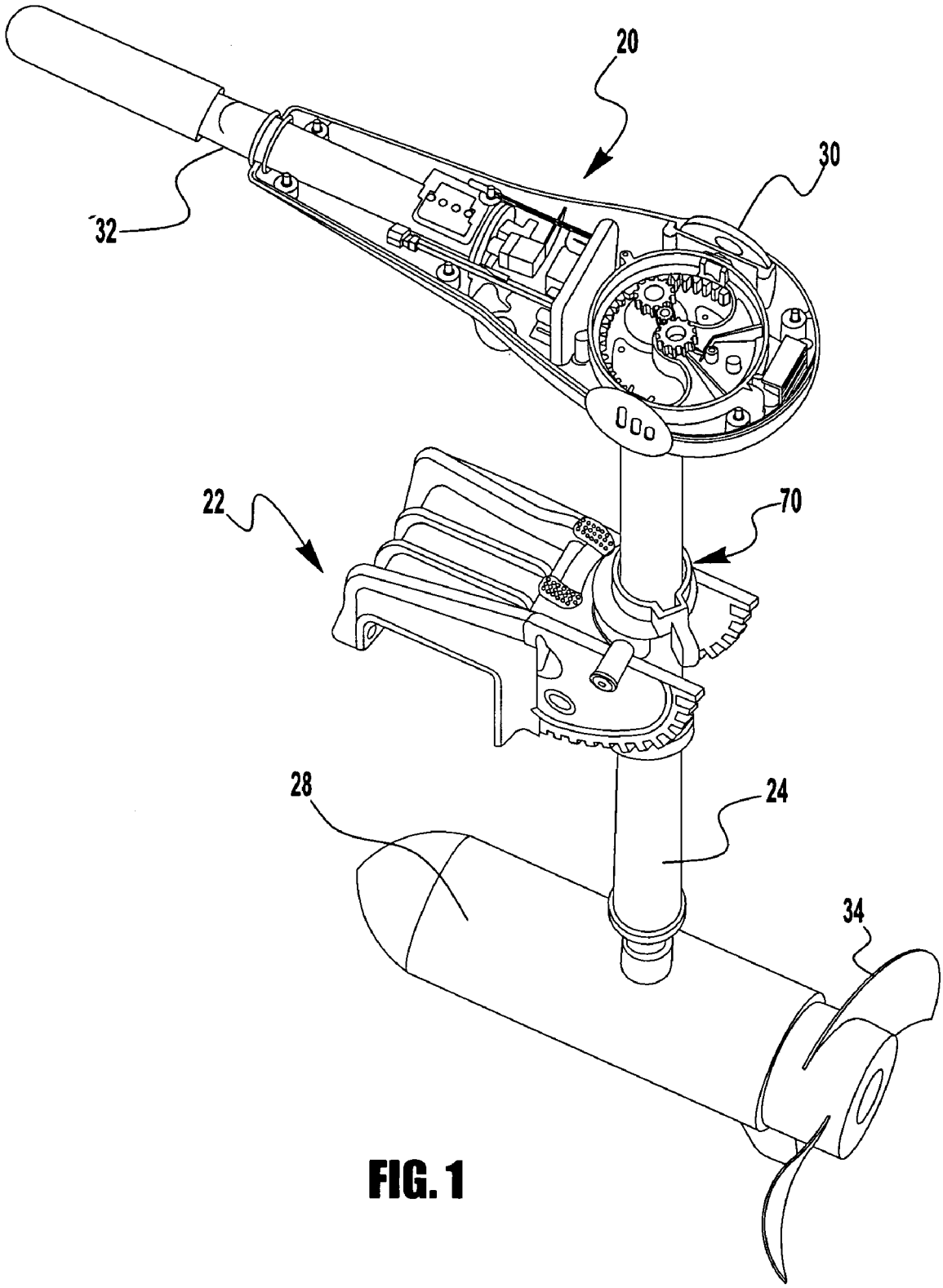
FIG. 1 is a perspective view of a trolling motor assembly according to an exemplary embodiment.

FIG. 1 is a perspective view of a trolling motor assembly 20 configured to be secured to a boat (not shown) at a location on the boat such as a bow or transom of the boat. Motor assembly generally includes boat mounting mechanism 22, an outer motor tube 24, an inner motor tube 26, a propulsion unit 28, a control unit 30 (such as a control box) and a steering control 32 (such as a handle). Mounting mechanism 22 is preferably secured (e.g., clamped) to the boat by a conventionally known clamping mechanism (not shown). Mounting mechanism 22 also enables propulsion unit 28 and control unit 30 to be rotated or pivoted relative to the boat (e.g., provide tilt adjustment for motor assembly 20).

Propulsion unit 28 comprises a conventionally known electric motor having a propeller 34. The motor rotatably drives propeller 34 to generate thrust used to move the boat. The amount of thrust generated by propulsion unit 28 may be altered by conventionally known methods such as using variable speed motors. As will be appreciated, the propulsion unit may alternatively comprise various other submergible devices or mechanisms for generating thrust.

The direction of thrust applied to the boat by propulsion unit 28 may be reoriented to change the direction of travel of the boat. Propulsion unit 28 is rotated around a vertical axis relative to mounting mechanism 22 by a user applying a force or otherwise rotating steering control 32, thereby causing rotation of control unit 30, inner tube 26 coupled to control unit 30, and propulsion unit 28 coupled to inner tube 26.

Figure 2:
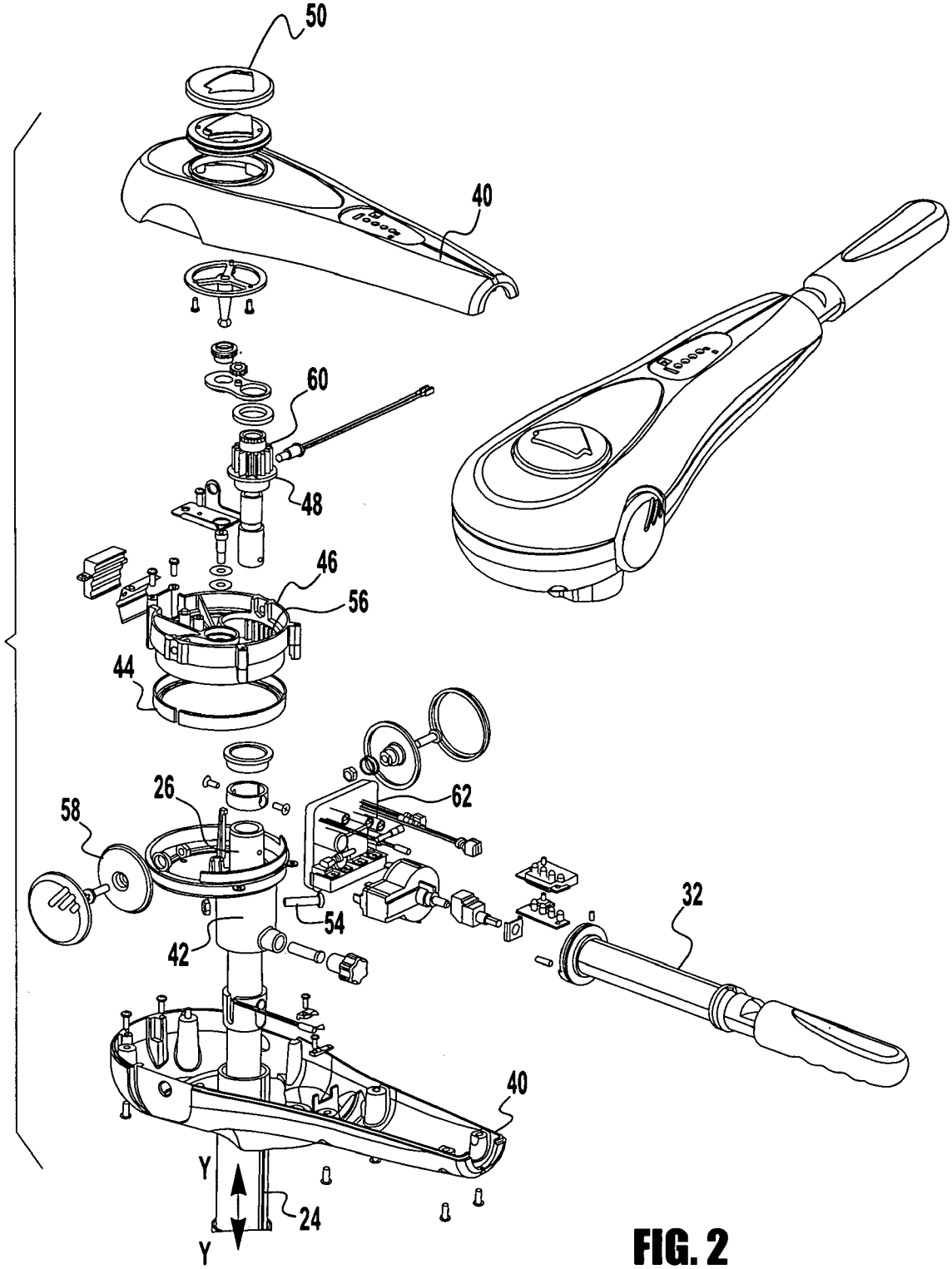
FIG. 2 is an exploded perspective view of a control unit of the trolling motor shown in FIG. 1.

FIG. 2 shows in greater detail control unit 30. Control unit 30 provides or allows for articulated steering of motor assembly 20. For example, articulated steering advantageously allows a first amount of rotation of control unit 30 to result in a second amount of rotation of propulsion unit 28.

Control unit 30 generally comprises housing 40 (shown as a split or two-part case, housing, etc.), yoke 42, bearing 44, gear carrier 46 (e.g., drum, gear ring, rack, etc.), pinion 48, and direction indicator assembly 50.

Figure 9:
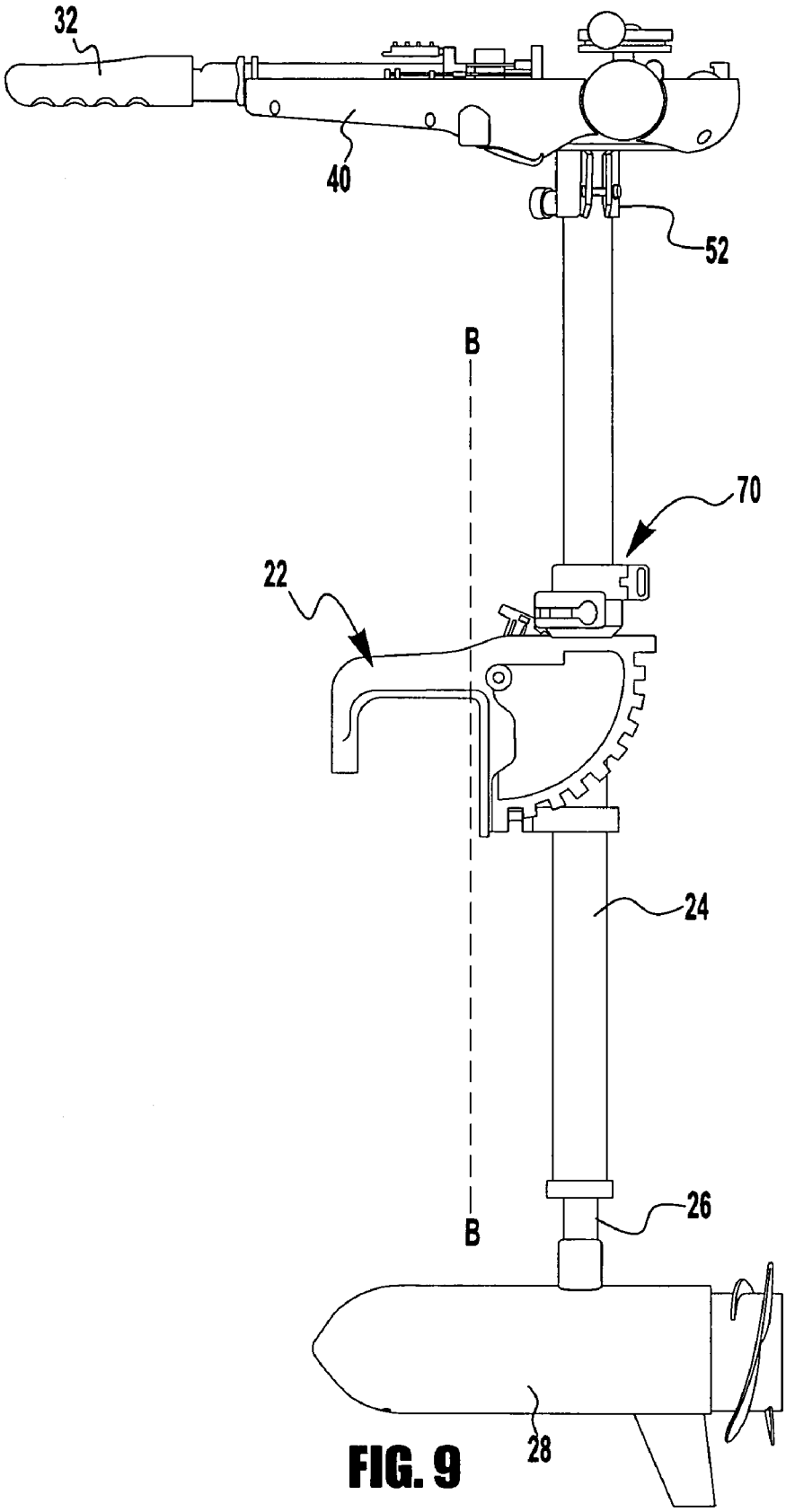

Yoke 42 and outer tube 24 are coupled to each other. Preferably, yoke 42 and outer tube 24 are fixed with respect to each other such that movement or rotation around a vertical axis (shown as axis Y-Y) of outer tube 24 causes rotation of yoke 42. As shown in FIG. 9, yoke 42 includes a split tube portion 52 which is sized to fit over an end portion of outer tube 24. Yoke 42 and outer tube 24 are fixed or coupled by tightening fastener 54 (shown in FIG. 2) which causes the split tube portion 52 to tighten and fix the position of yoke 42 with respect to outer tube 24.

Bearing 44 is provided between yoke 42 and gear carrier 46. According to a preferred embodiment, bearing 44 has a circular shape sized to fit or otherwise be received in a corresponding portion of yoke 42. Bearing 44 may be constructed from a variety of shapes, configurations or materials which allow or otherwise provide for the relative movement between yoke 42 and gear carrier 46, including nylon, Teflon, etc.

According to a preferred embodiment, gear carrier 46 comprises a substantially circular body configured to coact with bearing 44. Gear carrier 46 comprises gear teeth 56 provided around an inner periphery of gear carrier 46. According to a particularly preferred embodiment, gear teeth 56 are provided around 192 degrees of the inner periphery of gear carrier 46.

Gear carrier 46 and housing 40 are fixed with respect to each other in a horizontal plane such that rotation of housing 40 around an axis parallel to axis Y-Y causes rotation of gear carrier 46 around an axis parallel to axis Y-Y. Housing 40 may rotate or pivot with respect to gear carrier 46 around an axis defined by pivot knobs 58.

Gear teeth 56 of gear carrier 46 engage gear teeth 60 provided on pinion 48. Pinion 48 is coupled to inner tube 26. Inner tube 26 is provided within outer tube 24. Inner tube 26 is rigidly coupled to propulsion unit 28 such that rotation of inner tube 26 (via pinion 48) causes a corresponding rotation of propulsion unit 28. Rotation of handle 32 around axis Y-Y causes rotation of gear carrier 56 around axis Y-Y. Rotation of gear carrier 56 (and the meshing gear teeth 56 and 60) cause rotation of pinion 48, inner tube 26 and propulsion unit 28 around a parallel and offset axis to axis Y-Y.

According to a particularly preferred embodiment, gear carrier 46 and pinion 48 have a gear ratio of approximately 3.3 to 1. In other words, a rotation of gear carrier 46 through X degrees causes pinion 48 to rotate 3.3X degrees (and accordingly, a rotation of 3.3X degrees of inner tube 26 and propulsion unit 28). A 3.3 to 1 gear ratio provides a user with advantages of articulated steering described above while not providing a relatively high sensitivity of steering. For example, the 3.3 to 1 is not as sensitive to movement as a trolling motor assembly having higher gear ratios such as 4 to 1, etc. The 3.3 to 1 gear ratio may find particular suitability with "recreational" users (i.e., infrequent or average users as compared to an expert user) who may not be as adept or comfortable with a higher gear ratio. Alternatively, a variety of other gear ratios (such as higher and lower gear ratios) may be used.

Inner tube 26 is further configured to receive and allow passage of control and power cables or wires (not shown) from a control board 62 (such as a microprocessor, control circuit, etc.) to propulsion unit 28.

Figure 3:
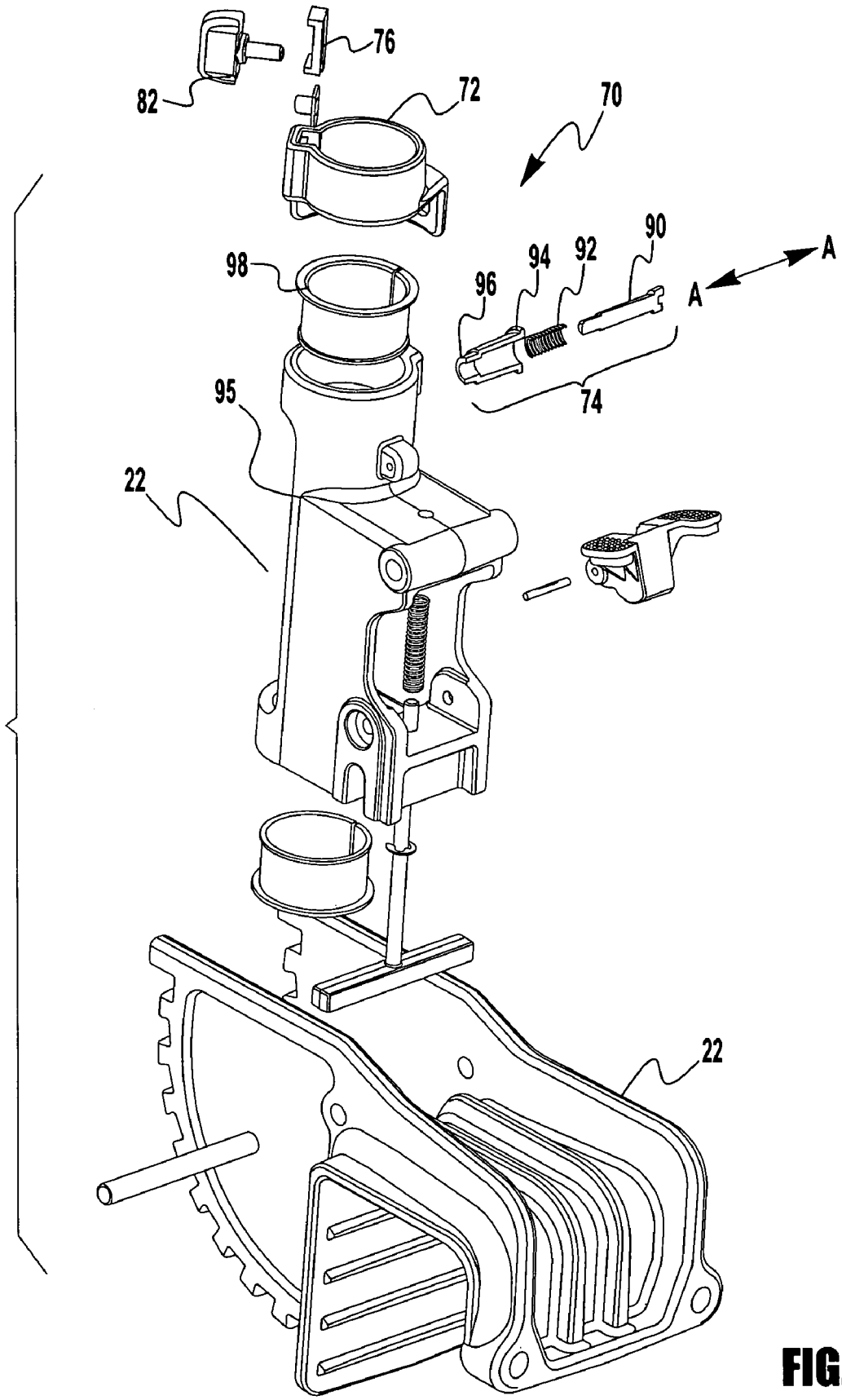
FIG. 3 is an exploded perspective view of a mounting mechanism and orientation collar for the trolling motor assembly shown in FIG. 1.
Figure 4:
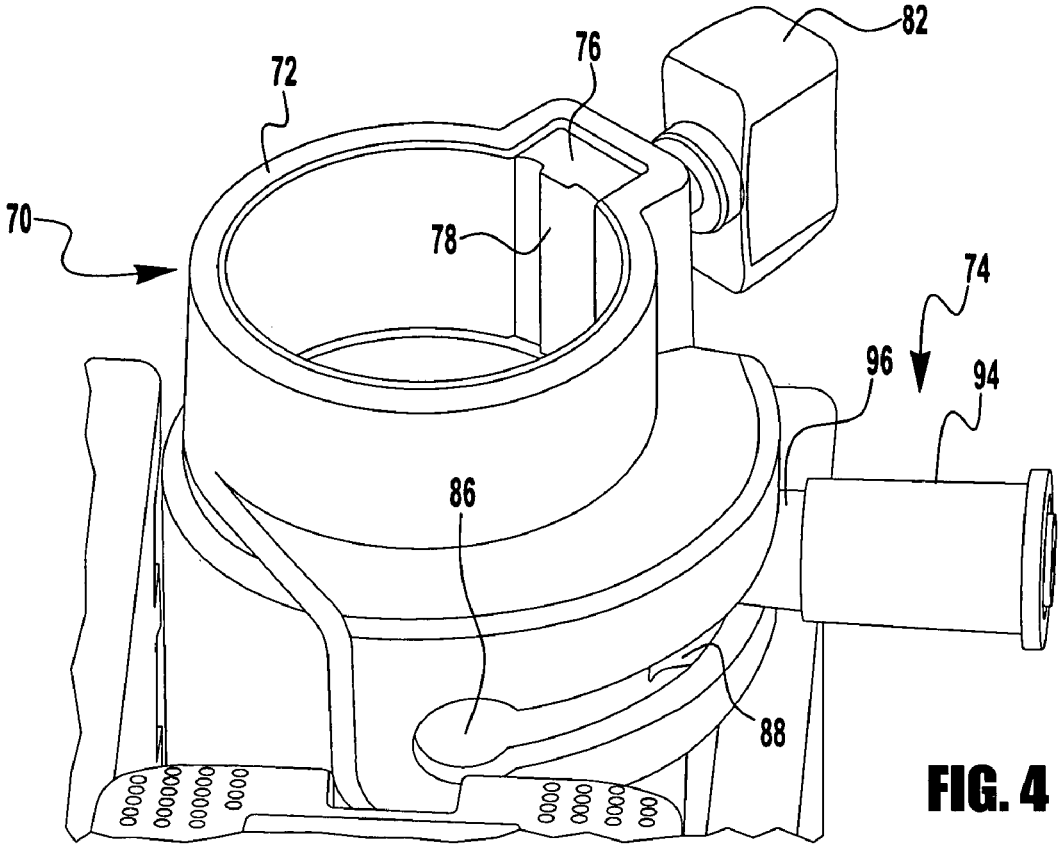
FIGS. 4 and 5 are perspective views of the orientation collar for the trolling motor assembly shown in FIG. 1.
Figure 5:
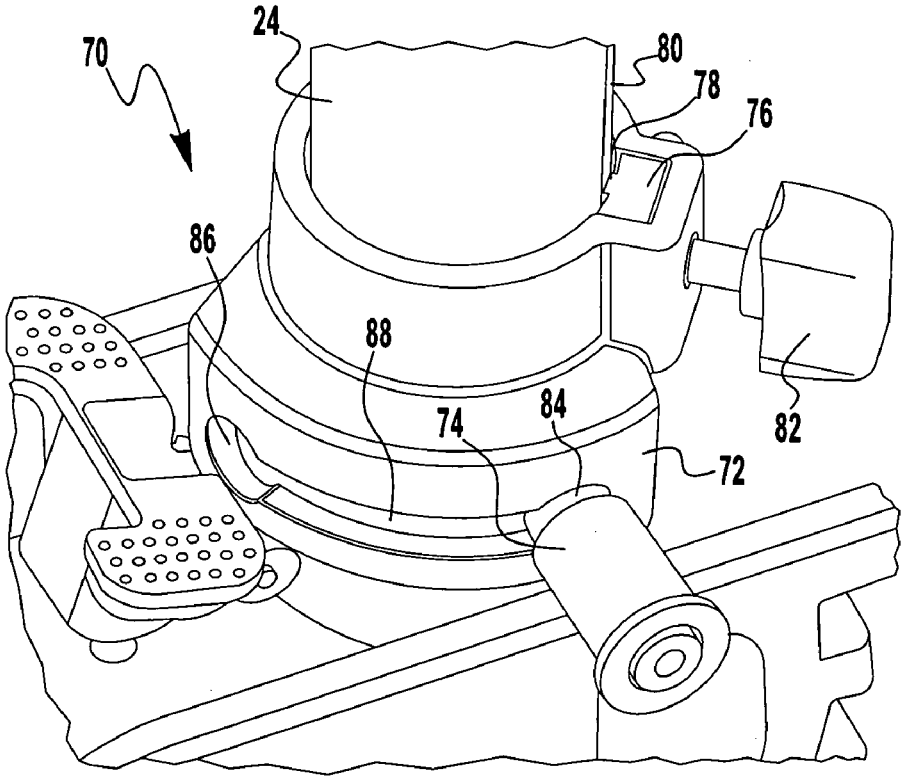
Figure 6:
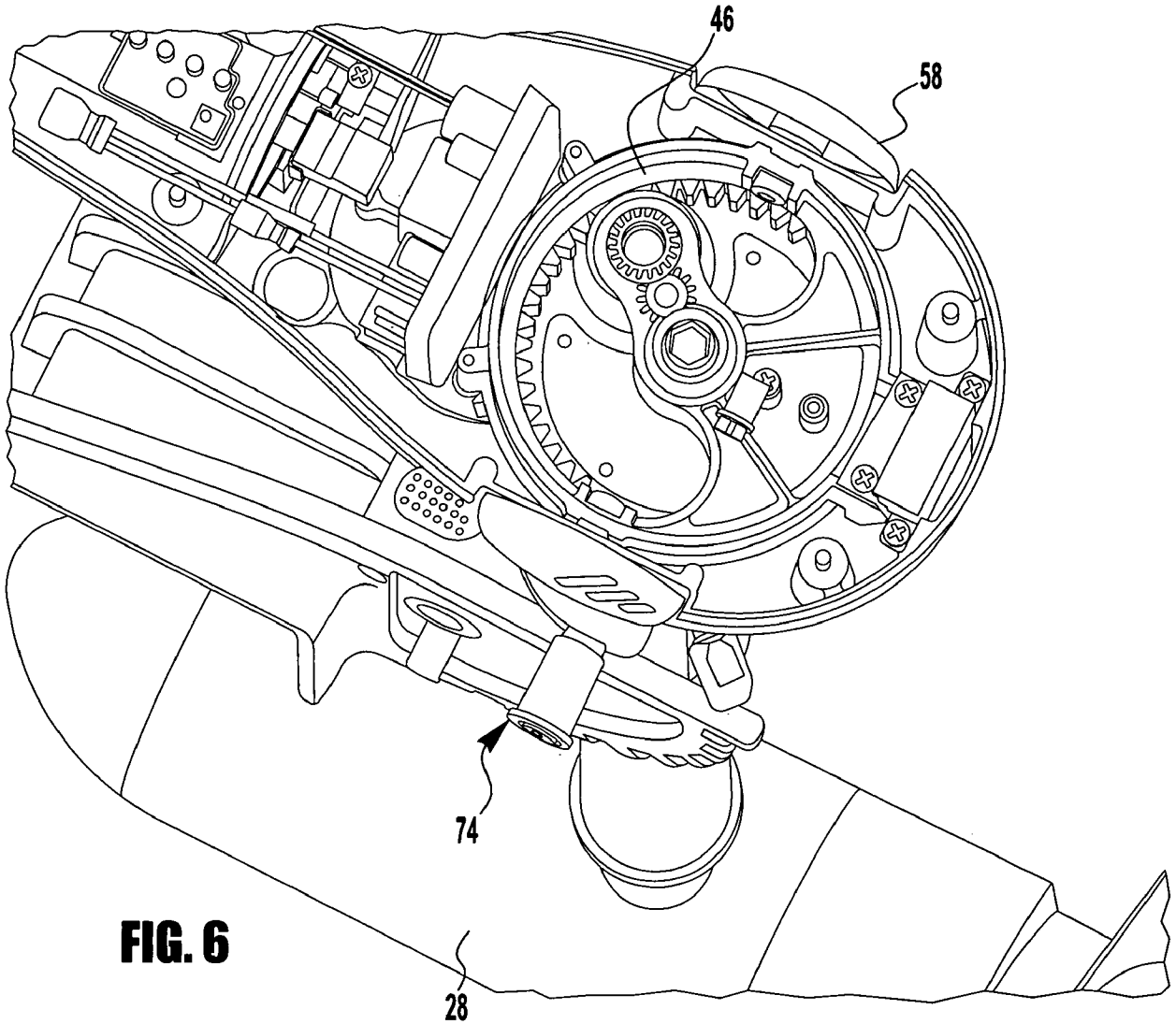
FIGS. 6 to 9 are perspective views of the trolling motor assembly in a forward troll orientation.
Figure 7:
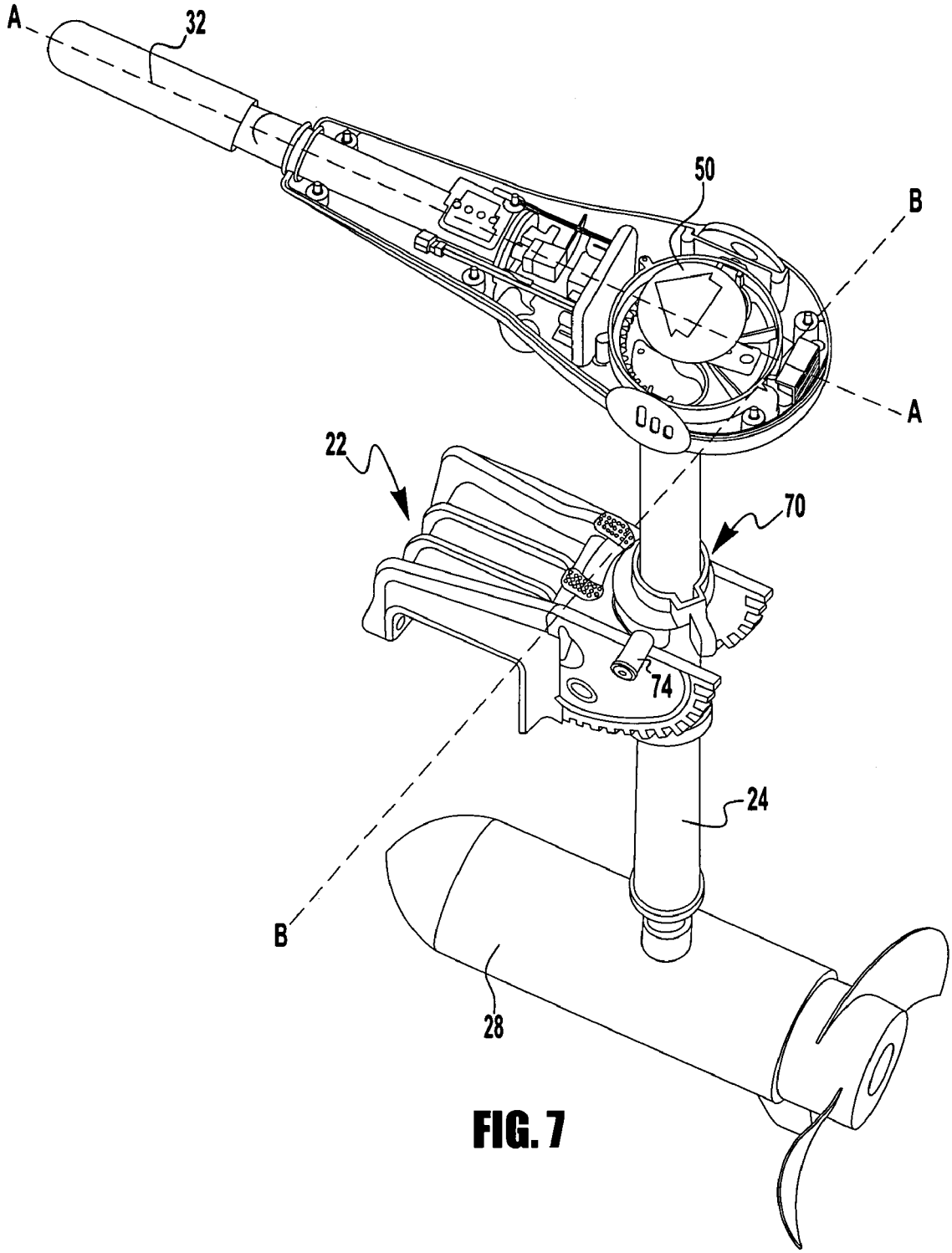

As shown in FIGS. 3 to 5, trolling motor assembly 20 further comprises an orientation assembly 70. Orientation assembly 70 is used to allow outer tube 24 (and correspondingly, propulsion unit 28) to be selectively reoriented or redirected (e.g., re-indexed, converted, etc.). According to a preferred embodiment, orientation assembly 70 is used to orient propulsion unit 28 in either a first position (i.e., a forward troll position) or a second position (i.e., a back troll position). Illustrating propulsion unit 28 in the forward troll position are FIGS. 6 to 9. Illustrating propulsion unit 28 in the back troll position are FIGS. 10 to 12. Propulsion unit 28 in the forward troll position is rotated 180 degrees around a vertical axis from propulsion unit 28 in the back troll position. According to various alternative embodiments, the first and second positions may be separated by any desired angle other than 180 degrees.

Orientation assembly 70 comprises a collar 72, pin 74, and key 76. Collar 72 is provided around an outer periphery outer tube 24. Collar 72 is fixed in rotation about a vertical axis with respect to outer tube 24 by key 76. Key 76 includes a protrusion 78 which extends into a slot 80 provided along a length of outer tube 24. Screw 82 (such as a thumb-screw) is coupled to key 76 through an aperture provided in collar 72.

Outer tube 24 (and trolling motor assembly 20) may be adjusted vertically by loosening screw 82 and adjusting outer tube 24 in a vertical direction (either up or down) to a desired vertical position. Once in an appropriate vertical position, outer tube 24 is held in place by tightening screw 82, thereby applying a holding force to key 76. Outer tube 24 is also received within bearings 98. Bearings 98 allow outer tube 24 (and propulsion unit 28 and control unit 30) to rotate around a vertical axis relative to mounting mechanism 22 when pin 74 is disengaged from collar 72 as described below.

As shown in FIGS. 4 and 5, collar 72 comprises a first aperture 84 (corresponding to a first position such as a forward troll position) and a second aperture 86 (corresponding to a second position such as a back troll position). First aperture 84 and second aperture 86 are connected by slot 88 preferably having a width less than the diameter of first aperture 84 and second aperture 86. According to a preferred embodiment, first aperture 84 and second aperture 86 are provided on a periphery of collar 72, separated by 78 degrees.

Referring back to FIG. 3, pin 74 (shown in cross-section) comprises an inner member 90, a spring 92 and an outer member 94. Inner member 90 is coupled to a body member 95 on mounting mechanism 22. Inner member 90 has a diameter less than the width of slot 88. Inner member 90 may be fixed to body member 95 with a threaded fastener provided on the end of inner member or any other conventional fastening means such as welding, adhesives, etc.

Spring 92 is provided between inner member 90 and outer member 94. According to a preferred embodiment, outer member 94 comprises a "necked-down" portion 96 sized to be received in first aperture 84 and second aperture 86. Portion 96 has a diameter larger than the width of slot 88 (i.e., sized to not fit or otherwise be received in slot 88). Outer member 94 is moveable along axis A-A. In operation, outer member 94 is pulled out of an engagement position (shown in FIG. 4). Collar 72 may then be reconfigured or reoriented from the first position to the second position by rotating collar 72 around a vertical axis. Once collar 72 is in the second position (as shown in FIG. 10), spring 92 urges or biases outer member 94 to engage collar 72 (i.e., portion 96 engaging or coacting in second aperture 86).

Figure 10:
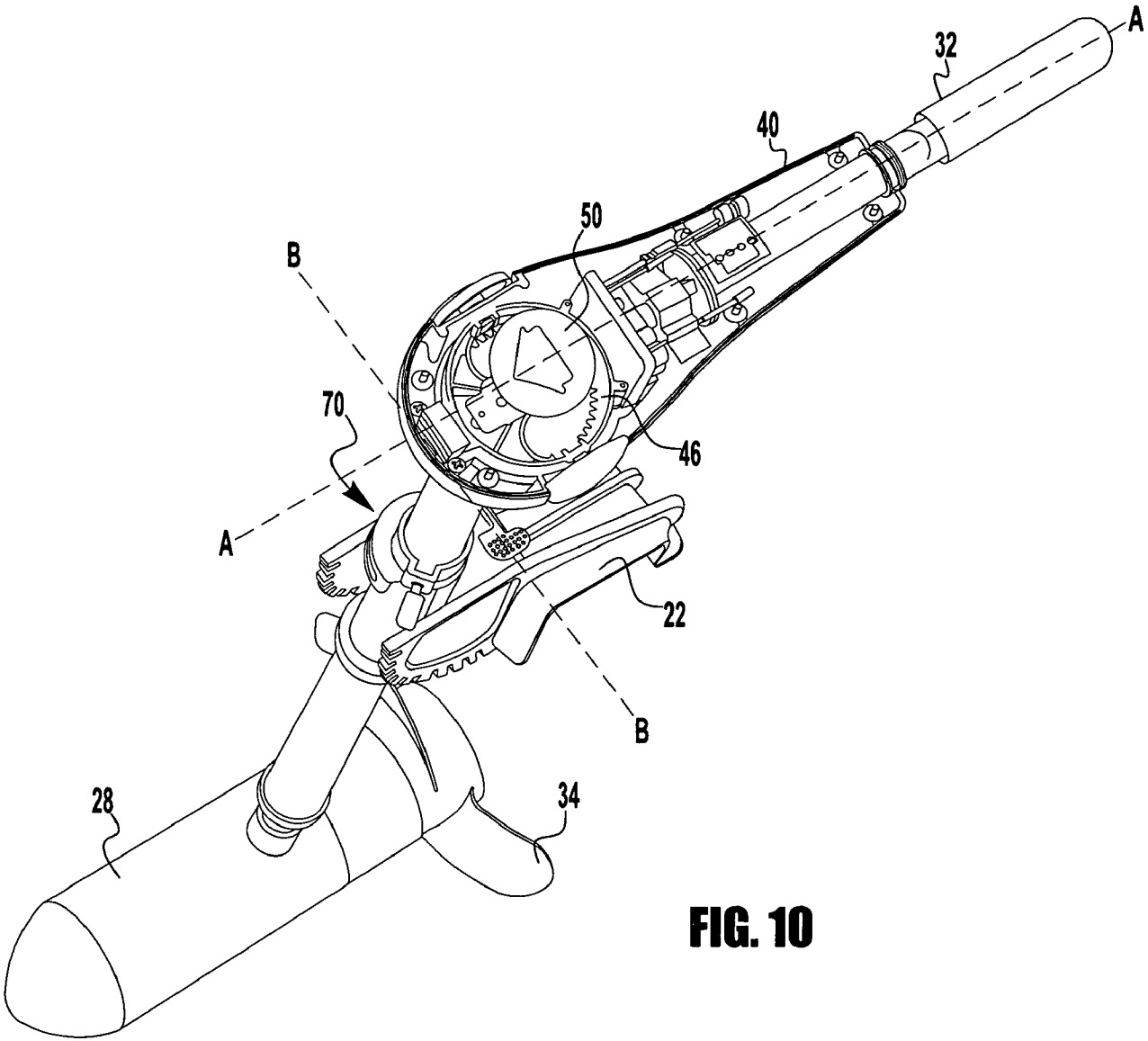
FIGS. 10 to 12 are perspective views of the trolling motor assembly in a back troll orientation.
Figure 11:
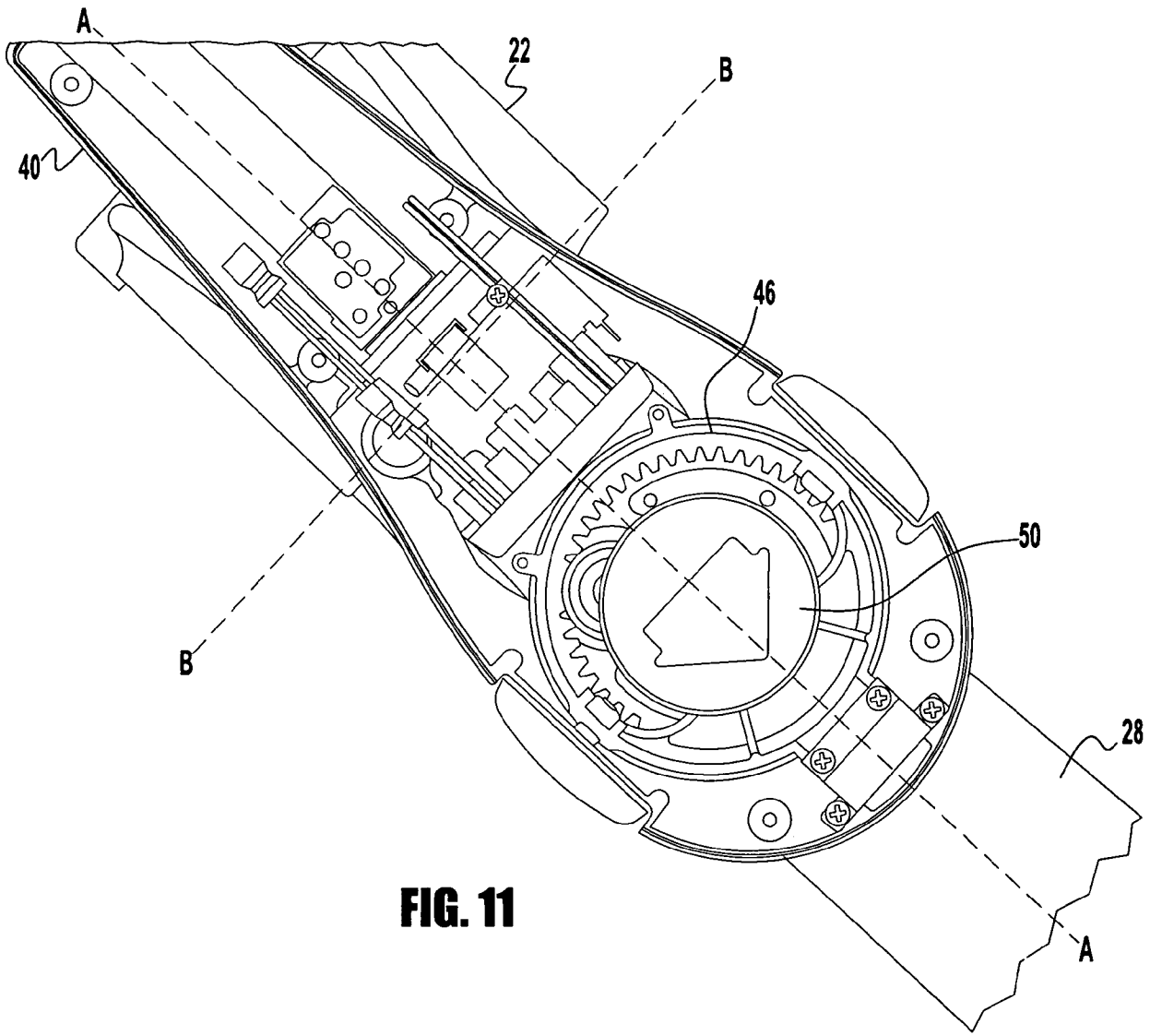
Figure 12:
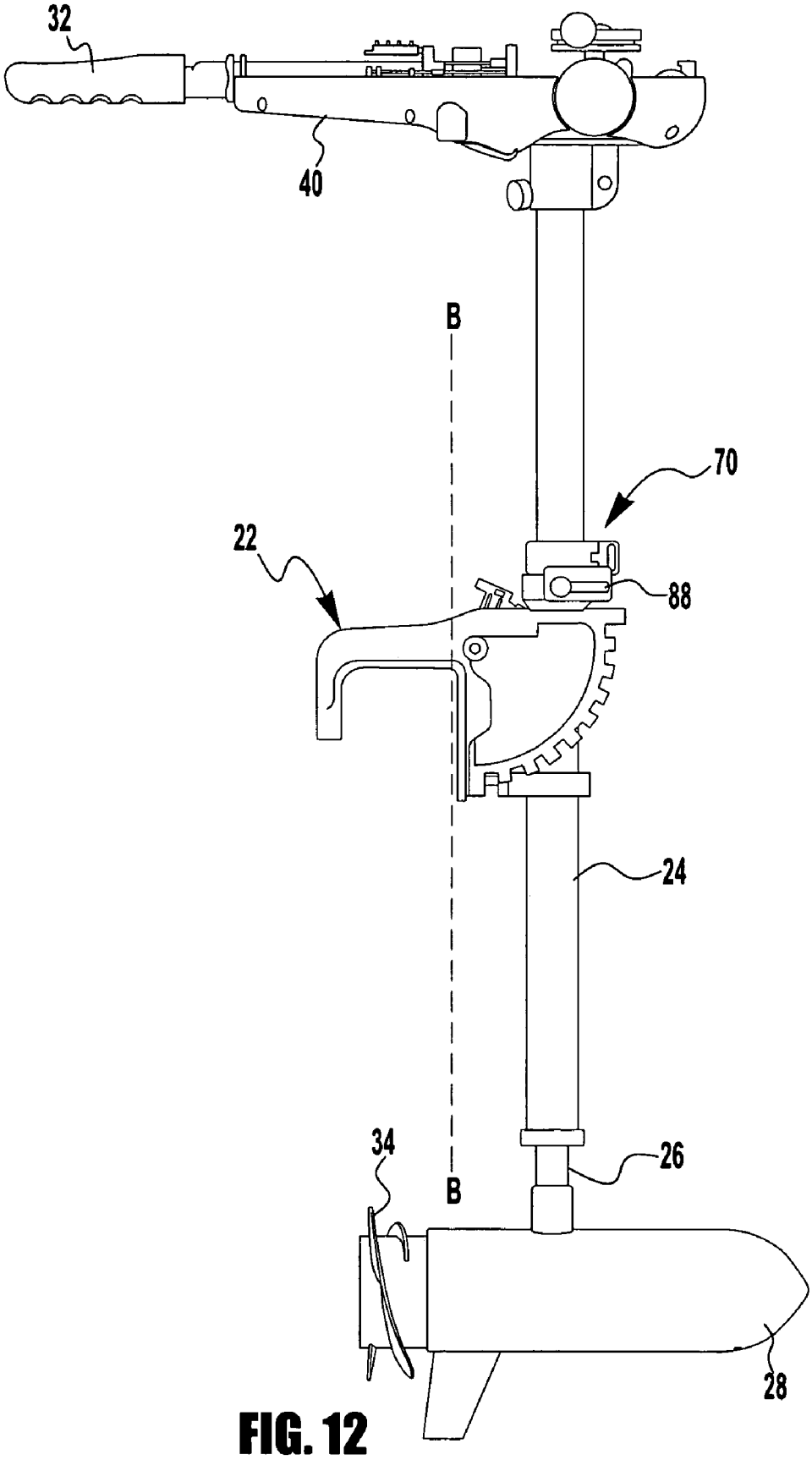

In operation, a user may wish to reorient or re-index trolling motor assembly 20 between a forward troll orientation (as shown in FIGS. 6 to 9) and a "back troll" orientation (as shown in FIGS. 10 to 12). According to a preferred embodiment, a user will disengage pin 74 from collar 72 to allow rotation. The user will then rotate handle 32 to a far counter-clockwise position (as seen from the top of trolling motor assembly 20). Rotation of handle 32 (with pin 74 disengaged) will cause rotation of control unit 30, outer tube 24 in bearings 98, inner tube 26 and propulsion unit 28. With pin 74 disengaged, yoke 42 and gear carrier 46 do not rotate relative to each other. Pin 74 will then re-engage collar 72. The user will then rotate handle 32 in a clockwise position to orient propulsion unit 28 in a back troll position (as shown in FIGS. 10 to 12). Pin 74 engaged with collar 72 results in yoke 42 and gear carrier 46 rotating relative to each other.

Figure 8:
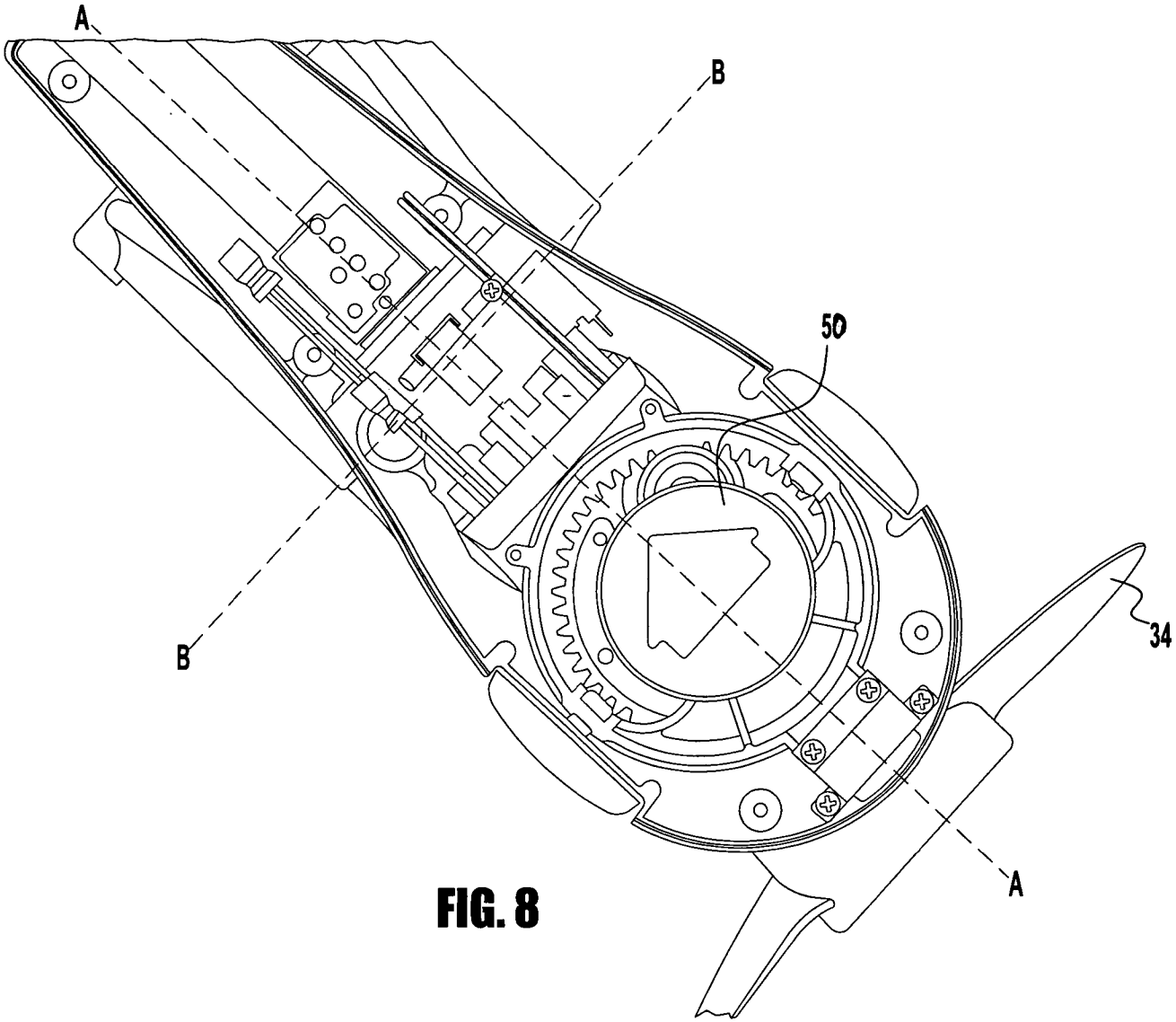

FIG. 8 (a forward troll position) shows pinion 48 to the right of "Plane A." FIG. 11 (a back troll position) shows pinion 48 rotated to the left of "Plane A." The change in relative position of pinion 48 with respect to "Plane A" allows for the rotation of propulsion unit 28 (via inner tube 26 coupled to pinion 48). Accordingly, propulsion unit 28 is also offset with respect to "Plan A" (see FIGS. 8 and 11).

It should be appreciated that trolling motor assembly 20 advantageously allows for relatively easily re-indexing or adjusting to alternate between forward trolling and back-trolling without disengaging and re-engaging any geared components.

It is also important to note that the construction and arrangement of the elements of the trolling motor as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, or the length or width of the structures and/or members or connectors or other elements of the system may be varied. It should be noted that the elements and/or assemblies of the system may be constructed from any of a wide variety of materials that provide sufficient strength or durability, in any of a wide variety of colors, textures and combinations. It should also be noted that the trolling motor may be configured in a suitable configuration to be used in association with a wide variety of other applications. Accordingly, all such modifications are intended to be included within the scope of the present inventions. Other substitutions, modifications. changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A trolling motor comprising:

a propulsion unit;

a steering control unit configured to control the orientation of the propulsion unit;

a motor tube coupling the steering control unit to the propulsion unit, the motor tube including a first tube section and a second tube section;

a mount system having a first portion adapted to be mounted to a watercraft and a second portion adapted to receive the motor tube; and an orientation system adapted to convert the trolling motor between a first orientation and a second orientation, the orientation system includes an engagement device movable between a first engaged position, a disengaged position and a second engaged position, wherein the first engaged position corresponds to the first orientation, and wherein the second engaged position corresponds to the second orientation, wherein the orientation system further comprises a collar configured to receive the second tube section, the collar having a first aperture corresponding to the first engaged position and the second aperture corresponding to the second engaged position, and a slot connecting the first aperture and the second aperture.

2. The trolling motor of claim 1, wherein the steering control unit comprises:

a housing;

a first gear portion coupled to the housing such that rotation of the housing causes rotation of the first gear portion; and a second gear portion having a first end configured to engage the first gear portion and a second end operably coupled to propulsion unit so that rotation of the second gear portion causes rotation of the propulsion unit.

3. The trolling motor of claim 2, wherein the first gear portion is a gear carrier having gear teeth provided around an inner periphery of the gear carrier and the second gear portion is a pinion having gear teeth corresponding to the gear teeth of the gear carrier.

4. The trolling motor of claim 3, wherein the pinion is coupled to a first end of the first tube section and the propulsion unit is coupled to a second end of the first tube section.

5. The trolling motor of claim 2, wherein the steering control unit provides for articulated steering of the propulsion unit.

6. The trolling motor of claim 5, wherein the gear carrier and the pinion have a gear ratio of approximately 3 to 1.

7. The trolling motor of claim 5, wherein the gear carrier and the pinion have a gear ratio of 3.3 to 1.

8. The trolling motor of claim 1, wherein the steering control unit further comprises a user interface to allow a user to selectively position the propulsion unit.

9. The trolling motor of claim 8, wherein the user interface is a handle member connected to the steering control unit.

10. The trolling motor of claim 1, wherein the steering control unit further comprises a direction indicator assembly.

11. The trolling motor of claim 2, wherein the steering control unit further comprises a yoke disposed between the first gear section and the second tube section, the yoke is coupled to the second tube section so that rotation of the second tube section causes rotation of the yoke.

12. The trolling motor of claim 11, wherein the yoke is movable relative to the first gear section.

13. The trolling motor of claim 12 wherein a bearing is provided between the yoke and the gear carrier to allow for the relative movement between the yoke and the first gear section.

14. The trolling motor of claim 1, wherein the first engaged position is a forward troll position and the second engaged position is a back troll position.

15. The trolling motor of claim 14, wherein the propulsion unit in the back troll position is approximately 180 degrees rotated from the position of the propulsion unit in the forward troll position.

16. The trolling motor of claim 1, wherein one of the first aperture and the slot are configured to receive a larger engagement device than the other of the first aperture and the slot.

17. The trolling motor of claim 1, wherein the engagement device is a locking pin having an inner member, an outer member, and a biasing element.

18. The trolling motor of claim 17, wherein the inner member is inserted into the slot for slideable movement therein, and is fixedly coupled relative to the second tube section.

19. The trolling motor of claim 18, wherein the inner member is coupled to the mount system.

20. The trolling motor of claim 19, wherein the inner member is threadably coupled to the mount system.

21. The trolling motor of claim 18, wherein the slot in the collar guides the movement of the collar along the inner member.

22. The trolling motor of claim 17, wherein the biasing element urges the outer member towards the collar.

23. The trolling motor of claim 22, wherein a spring is provided between the inner member and the outer member.

24. The trolling motor of claim 1, wherein the position of the propulsion unit maybe selectively adjusted in a vertical direction.

25. The trolling motor of claim 24, wherein the second tube section includes a recess extending substantially the length of the second tube section.

26. The trolling motor of claim 25, wherein the orientation system includes a key having a protrusion configured to slidably engage the recess, the key is movable between a locked position and an adjustment position, wherein the key in the locked position restricts the vertical movement of the second tube section.

27. The trolling motor of claim 1, wherein the first tube section is an inner tube section and the second tube section is an outer tube section.

28. The trolling motor of claim 2, wherein the trolling motor assembly can be converted without disengaging the first gear portion from the second gear portion.

29. A trolling motor assembly comprising:

a propulsion unit;

a steering control unit comprising:

a housing:

a first gear portion coupled to the housing such that rotation of the housing causes rotation of the first gear portion; and a second gear portion having a first end configured to engage the first gear portion and a second end operably coupled to propulsion unit so that rotation of the second gear portion causes the orientation of the propulsion unit to be altered;

a motor tube having a first tube section and a second tube section;

a mount system having a first portion adapted to be mounted to a watercraft and a second portion adapted to support the propulsion unit;

an orientation system configured to re-index the trolling motor assembly between a forward troll position and a back troll position, the orientation system includes a collar and a pin, wherein the collar is rotated relative the pinto convert the trolling propulsion unit between the forward troll position and the back troll position.

30. The assembly of claim 29, wherein the first gear portion is a gear carrier having gear teeth provided around an inner periphery of the gear carrier and the second gear portion is a pinion having gear teeth corresponding to the gear teeth of the gear carrier.

31. The assembly of claim 30, wherein the pinion is coupled to a first end of the inner tube section and the propulsion unit is coupled to a second end of the inner tube section.

32. The assembly of claim 30, wherein the steering control unit provides for articulated steering of the propulsion unit.

33. The assembly of claim 32, wherein the gear carrier and the pinion have a gear ratio of approximately 3 to 1.

34. The assembly of claim 32, wherein the gear carrier and the pinion have a gear ratio of 3.3 to 1.

35. The trolling motor assembly of claim 29, wherein the pin includes an inner member and an outer member.

36. The trolling motor assembly of claim 35, wherein a spring is disposed between the inner member and the outer member.

37. The trolling motor assembly of claim 35, wherein the collar includes a slot configured to receive the inner member.

38. The trolling motor assembly of claim 37, wherein a first aperture defines a first end of the slot and a second aperture defines a second end of the slot.

39. The trolling motor of assembly of claim 38, wherein the first aperture is approximately 80 degrees rotated from the second aperture.

40. The trolling motor assembly of claim 38, wherein the outer member is configured to releasably engage the first aperture and the second aperture.

41. The trolling motor assembly of claim 38, wherein the propulsion unit is in the forward trolling position when the outer member engages the first aperture, and in the back trolling position when the outer member engages the second aperture.

42. The trolling motor assembly of claim 35, wherein the inner member is coupled to the mounting mechanism.

43. The trolling motor assembly of claim 29, wherein the collar is coupled to the second tube member.

44. The trolling motor assembly of claim 29, wherein the trolling motor assembly can be reindexed without disengaging the first gear portion from the second gear portion.

45. A method of converting a trolling motor assembly between a forward troll position and a back troll position, the method comprising:

coupling an orientation collar to an outer motor tube section, the orientation collar includes a slot extending between a first aperture and a second aperture, wherein the first aperture corresponds to the forward troll position, and wherein the second aperture corresponds to the back troll position;

disengaging an outer locking member from the first aperture;

rotating a steering control unit in a manner that causes the orientation collar to slidably follow an inner locking member disposed in the slot until the outer locking member engages the second aperture;

wherein the collar is rotated relative the inner locking member to convert the trolling motor assembly between the forward troll position and the back troll position.

46. The method of claim 45, wherein the steering control unit comprises:

a housing;

a first gear portion coupled to the housing such that rotation of the housing causes rotation of the first gear portion; and a second gear portion having a first end configured to engage the first gear portion and a second end operably coupled to a propulsion unit so that rotation of the second gear portion causes the orientation of the propulsion unit to be altered.

47. The method of claim 46, wherein the steering control unit, when the trolling motor assembly is in the forward troll position or the back troll position, is rotatable by a user in a manner that rotates the a propulsion unit at a ratio of at least 3 to 1 relative to the rotation of the steering control unit.

48. A trolling motor comprising:

a propulsion unit;

a steering control unit comprising:

a housing;

a first gear portion coupled to the housing such that rotation of the housing causes rotation of the first gear portion; and a second gear portion having a first end configured to engage the first gear portion and a second end operably coupled to the inner tube section so that rotation of the second gear portion causes rotation of the propulsion unit;

a steering control unit configured to control the orientation of the propulsion unit;

a motor tube including an inner tube section having a lower end connected to the propulsion unit and an upper end coupled to the second gear portion, and an outer tube section having an upper end coupled to the housing;

a mount system having a first portion adapted to be mounted to a watercraft and a second portion adapted to receive the outer tube section of the motor tube; and an orientation system adapted to convert the trolling motor between a first orientation and a second orientation, the orientation system including a collar for selectively coupling the outer tube section to the mount system in a first engaged position that corresponds to the first orientation, and a second engaged position that corresponds to the second orientation.

49. The trolling motor of claim 48, wherein the first gear portion is a gear carrier having gear teeth provided around an inner periphery of the gear carrier and the second gear portion is a pinion having gear teeth corresponding to the gear teeth of the gear carrier.

50. The trolling motor of claim 48, wherein the steering control unit provides for articulated steering of the propulsion unit.

51. The trolling motor of claim 50, wherein the gear carrier and the pinion have a gear ratio of at least about 3 to 1.

52. The trolling motor of claim 48, wherein the steering control unit further comprises a user interface to allow a user to selectively position the propulsion unit.

53. The trolling motor of claim 52, wherein the user interface is a handle member connected to the steering control unit.

54. The trolling motor of claim 48, wherein the steering control unit further comprises a direction indicator assembly.

55. The trolling motor of claim 48, wherein the steering control unit further comprises a yoke disposed between the first gear section and the second tube section, the yoke is coupled to the second tube section so that rotation of the second tube section causes rotation of the yoke.

56. The trolling motor of claim 55, wherein the yoke is movable relative to the first gear section.

57. The trolling motor of claim 56 wherein a bearing is provided between the yoke and the gear carrier to allow for the relative movement between the yoke and the first gear section.

58. The trolling motor of claim 48, wherein the first engaged position is a forward troll position and the second engaged position is a back troll position.

59. A trolling motor assembly comprising:

a propulsion unit;

a steering control comprising:

a housing;

a first gear portion coupled to the housing such that rotation of the housing causes rotation of the first gear portion; and a second gear portion having a first end configured to engage the first gear portion and a second end operably coupled to propulsion unit so that rotation of the second gear portion causes the orientation of the propulsion unit to be altered;

a motor tube having an inner tube section coupled to the second gear portion and the propulsion unit and an outer tube section coupled to the housing;

a mount system having a first portion adapted to be mounted to a watercraft and a second portion adapted to support the propulsion unit;

an orientation system configured to re-index the trolling motor assembly between a forward troll position and a back troll position, by selectively coupling the outer tube section in either a first orientation or a second orientation with respect to the mount system.

60. The assembly of claim 59, wherein the first gear portion is a gear carrier having gear teeth provided around an inner periphery of the gear carrier and the second gear portion is a pinion having gear teeth corresponding to the gear teeth of the gear carrier.

61. The assembly of claim 60, wherein the pinion is coupled to a first end of the inner tube section and the propulsion unit is coupled to a second end of the inner tube section.

62. The assembly of claim 59, wherein the steering control unit provides for articulated steering of the propulsion unit.

* * * * *

UNITED STATES PATENT AND TRADEMARK OFFICE

CERTIFICATE OF CORRECTION

PATENT NO. : 7,056,166 B1
APPLICATION NO. : 10/864299
DATED : June 6, 2006
INVENTOR(S) : Darrel A. Bernloehr et al.

It is certified that error appears in the above-identified patent and that said Letters Patent is hereby corrected as shown below:

Column 7, Line 28, delete “maybe”, insert --may be--

Column 9, Line 1, delete “pinto”, insert --pin to--

Signed and Sealed this

Seventeenth Day of April, 2007

JON W. DUDAS
*Director of the United States Patent and Trademark Office*